US005186263A

United States Patent [19]

Kejr et al.

[11] Patent Number: 5,186,263

[45] Date of Patent: Feb. 16, 1993

[54] SOIL SAMPLE PROBE

[75] Inventors: Melvin P. Kejr; Thomas M. Christy, both of Saline, Kans.

[73] Assignee: Kejr Engineering, Inc., Salina, Kans.

[21] Appl. No.: 583,461

[22] Filed: Sep. 17, 1990

[51] Int. Cl.[5] ..... E21B 49/02

[52] U.S. Cl. ..... 175/20; 175/23; 175/58; 175/249

[58] Field of Search ..... 73/864.44, 864.45, 864.62; 175/58, 59, 244, 246, 248, 249, 251, 253, 403, 308, 309, 20, 19, 22, 23

[56] References Cited

U.S. PATENT DOCUMENTS

| | | | |
|---|---|---|---|
| 2,283,650 | 5/1942 | Sanborn | 175/23 X |
| 2,382,992 | 8/1945 | Harris | 175/20 |
| 2,664,269 | 12/1953 | Knight et al. | 73/864.44 X |
| 3,047,081 | 7/1962 | Pitcher | 175/20 X |
| 3,412,814 | 11/1968 | Rosfelder | 73/864.45 X |
| 3,794,127 | 2/1974 | Davis | 175/58 |
| 3,805,900 | 4/1974 | Sainsbury | 175/58 X |
| 4,098,360 | 7/1978 | Clements | 175/58 X |
| 4,317,490 | 3/1982 | Milberger et al. | 175/59 X |
| 4,588,036 | 5/1986 | Desrochers et al. | 175/58 |
| 4,669,554 | 6/1987 | Cordry | 175/59 |
| 4,729,437 | 3/1988 | Zapico | 175/58 X |
| 4,953,637 | 9/1990 | Starr et al. | 175/249 X |

FOREIGN PATENT DOCUMENTS

| | | | |
|---|---|---|---|
| 634680 | 9/1936 | Fed. Rep. of Germany | 175/20 |
| 769863 | 3/1957 | United Kingdom | 73/864.44 |
| 2054703 | 2/1981 | United Kingdom | 175/59 |

OTHER PUBLICATIONS

"Basic Procedures for Soil Sampling and Core Drilling", distributed by Acker Drill Co., Inc., pp. 16–17; published by Dec. 1990; by W. C. Acker III.

*Primary Examiner*—Tom Noland

*Attorney, Agent, or Firm*—Shook, Hardy & Bacon

[57] ABSTRACT

A device for obtaining soil samples beneath the surface of the ground. A sample tube is provided with a removable piston tip blocking the forward opening of the sample tube. Rearward movement of the piston tip is blocked by a removable piston stop. The sample tube is driven into the soil with the piston tip blocking its forward end. Tubular probe extension may be successively added to the rear of the device to allow driving of the sample tube to the desired depth. At the desired depth, the piston stop is removed to unblock the piston tip. The piston stop may be removed by a series of threadedly connected extension rods threadedly connected via a drivehead to the piston stop. The piston stop is threadedly connected to the sample tube with left-handed threads to ensure all other connections remain tight during removal. The sample tube is then driven forward, causing the soil sample to enter the tube and the tip to slide within the tube. The tube is then withdrawn from the soil to recover the sample.

17 Claims, 2 Drawing Sheets

SOIL SAMPLE PROBE

BACKGROUND OF THE INVENTION

1. Field of the Invention

The present invention pertains to probes for obtaining soil samples below the surface of the ground.

2. Description of the Prior Art

It has long been desirable to obtain samples of subterranean soil conditions for various purposes. Early uses of soil samples were determination of soil conditions prior to construction of structures on the ground and attempted location of mineral deposits. Devices for obtaining such samples vary with the type of sample required.

A large number of contemporary uses for samples require only a relatively small sample, on the order of 25 cm (10") long with a 2.5 cm (1") diameter, taken from a particular depth which is often somewhat greater than 9 meters (30'). While still useful for determining construction site suitability, such samples are also used in studies of chemical dissipation and residue, determination of concentration of environmental contaminants, investigating of hazardous waste sites and other uses.

A known device for taking such samples is produced by the Acker Drill Co., Inc. of Scranton, Pa. This device consists of a cylindrical sample casing open at both ends. A rearward end of the casing is threaded to receive a similar cylindrical extension. Successive extensions are added, by threading, to extend the casing to the desired depth.

A plug is located in the casing at the forward end during driving of the casing to ensure that soil does not enter the casing until the proper depth is reached. A rod extends rearwardly from the plug, along the length of the casing and extensions, and pressure is applied to this rod during driving of the casing to maintain the plug in the operative position. A series of rod extensions are added to the rod when required, in a manner similar to the casing extensions.

When the desired depth is reached, the plug is retracted to abut against a stop in the interior of the casing. The casing is then driven to force soil into the sample casing. The device is then withdrawn from the soil to recover the sample.

The main problem with such a device is the need to drive both the casing (or its extensions) and the plug (or its extensions). The driving of the plug extensions can cause vibrations therein which cause the plug to move slightly out of position, contaminating the sample. Driving of the plug also requires that the plug rod extensions be sufficiently rugged to drive the plug, increasing weight and cost.

Another prior art device overcomes this problem by releasably fixing the plug to the front of a soil sample tube with a locking mechanism during driving. When the desired depth has been reached a cable connected to the locking mechanism is pulled to unlock the mechanism. The casing is driven to collect the sample, and the casing is then removed from the soil to retrieve the sample. This arrangement is disadvantageous in that the locking mechanism is located in the front end of the casing. This necessarily requires a larger outer diameter for the soil sampling tube, which results in increased driving forces being needed to insert the casing into the soil.

Another disadvantage with this type apparatus is that a continuous cable must run from the locking mechanism at the soil sample tube to the soil surface. This usually requires the threading of the cable in to the incrementally added sections of the casing.

SUMMARY OF THE INVENTION

To solve the above-noted problem, the present invention releasably fixes a piston tip, acting as a plug, to a sample tube in the operative position during driving. In this manner, only the extensions of the sample tube need be driven to the desired depth. When the desired depth is reached, the piston tip is released from its fixed position and is free to move along the length of the sample tube. Continued driving of the sample tube extensions forces the sample tube forward while the piston tip remains at its position with respect to the soil. The device is then removed from the soil to recover the sample.

The piston tip is releasably fixed to the sample tube through the use of a removable stop. The piston stop includes a piston rod extending rearwardly through the sample tube. The rearward end of the piston rod is received in a through hole in a drive head fixed to the rearward end of the sample tube. During driving the through hole is blocked, behind the piston rod, by a removable piston stop. By blocking rearward movement of the piston rod, rearward movement of the piston tip is blocked.

The piston stop is preferably a threaded member screwed into the through hole in the drive head. With this arrangement, an extension rod (with appropriate extensions) may be used to unscrew and withdraw the piston stop at the appropriate time. Forming the piston stop with left-handed threads for the connection with the drive head is particularly advantageous.

BRIEF DESCRIPTION OF THE DRAWINGS

The various aspects of the invention are described in detail below, with reference to the drawings, in which.

FIGS. *3a–3c* are cross-sectional views of the operation of the device of the present invention.

DETAILED DESCRIPTION OF THE INVENTION

Figure 1:
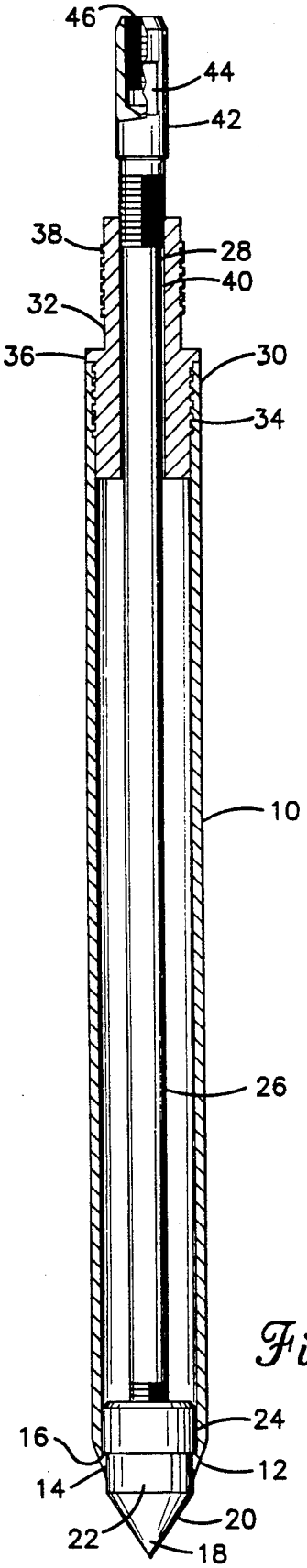
FIG. 1 is a cross-sectional view of the soil sample probe of the present invention.

The assembled sample collecting portion of the soil sampler is shown in FIG. 1. The sample collecting portion is elongated in the direction of driving for ease of insertion into the soil. While composed of several parts, it is initially noted that the sample collecting portion is a rigid unit as shown in FIG. 1, and this condition is maintained until the sample collecting portion has been driven to the desired depth.

The sample collecting portion includes an elongated sample tube or sample container 10. The sample tube 18 is formed as an elongated seamless cylinder with open ends, although configurations other than cylindrical are contemplated. The exterior of the sample tube is preferably somewhat smooth and continuous to reduce friction during movement through the soil. A preferred material for the sample tube is high strength alloy steel. Non-alloyed metal and sufficiently rugged non-metallic materials could also be used to form the sample tube.

The forward end, in the direction of insertion, of the sample tube 10 may include a tapered section 12 to ease insertion and therefore reduce the required driving force. The majority of the interior wall or walls of the sample tube are also preferably smooth and continuous for reasons discussed below. Exceptions to the smooth, continuous inner wall occur at both longitudinal ends of the sample tube 10.

The interior of the forward end of sample tube 10 includes a cylindrical tube portion 14 which terminates rearwardly of the forward end in a tube shoulder 16. Tube portion 14 and tube shoulder 16 cooperate with a piston tip 18 to seal the forward end of the sample tube against ingress of soil prior to the taking of the sample.

The piston tip 18 includes a forward portion 20, which is preferably conical or pointed to ease insertion. Rearwardly of portion 20 is a cylindrical tip portion 22 which slidingly mates with tube portion 14 to seal sample tube 10. The piston tip 18 also includes a cylindrical tip body 24 which has a larger diameter than tip portion 22. The intersection of tip portion 22 and tip body 24 forms a shoulder on piston tip 18 which substantially mates with tube shoulder 16, and tip body 24 slidingly mates with the interior wall of sample tube 10. These mating arrangements further seal the interior of sample tube 10.

A piston rod 26 extends rearwardly of piston tip 18. Piston rod 26 may be formed integrally with piston tip 18, but it is preferred that piston rod 26 be connected to piston tip 18, as by a standard threaded connection, to reduce manufacturing costs. Piston rod 26 extends rearwardly through sample tube 10, and ends in a free end 28 in proximity to a rearward end 30 of sample tube 10.

Releasably connected to sample tube end 30 is a drive head 32. This releasable connection at the forward end of drive head 32 may be formed by standard threads 34. An engagement portion 36 may provide exterior surfaces adapted to engagement with a proper tool to tighten threads 36, and may also provide a shoulder which abuts against the rearward end 3 to further seal sample tube 10. The rearward end of drive head 32 includes exterior standard threads 38, used for a purpose described below.

A through-hole 40 extends through the length of drive head 32, coaxially to the sample tube 10. A portion of drive rod 26, including free end 28, is received within through-hole 40 with sliding clearance. The result of this sliding clearance, and the sliding clearances between the piston tip and the sample tube, is that the piston tip and piston rod may move together with respect to the sample case if this movement is unimpeded.

In FIG. 1, however, such movement of the piston tip and piston rod is blocked by piston stop 42. Piston stop 42 is releasably fixed to drive head 32 within hole 40, with a forward end of piston stop 42 abutting free end 28 of piston rod 26. Piston stop 42 should of course be fixed to head 32 with a sufficiently strong connection to resist the forces of the soil upon conical tip portion 20, to maintain the sample case sealed during driving.

It is preferred that this connection be formed as mating reverse, or left-handed, threads formed on the forward end of piston stop 42 and formed in head 32 proximal the rearward end of through-hole 40. The significance of reverse threading is discussed in further detail below. The periphery of the rearward end of piston stop 42 may be appropriately shaped, as at 44, for engagement with a tool to tighten piston stop 42 in place. When tightened in place, piston stop 42 abuts against free end 28 with sufficient force to maintain piston tip 18 and piston rod 26 fixed against the force of the soil. The interior of the rear end of piston stop includes standard threads 46, the purpose of which is explained below.

Figure 2:
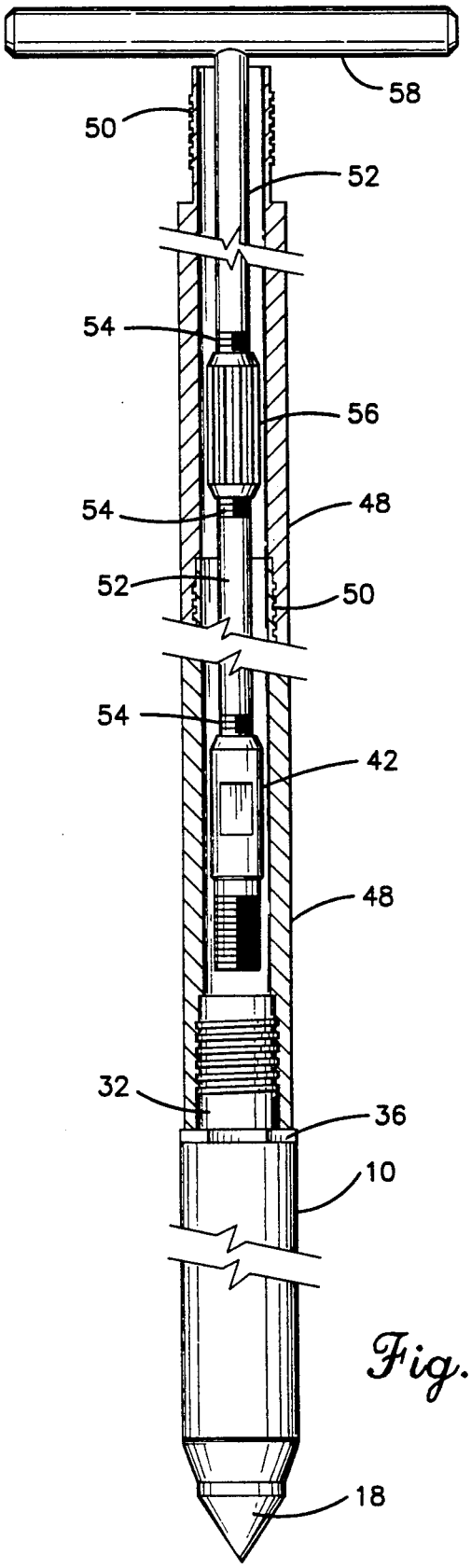
FIG. 2 is a partial cross-sectional view of the fully assembled device of the present invention.
Figure 3A:
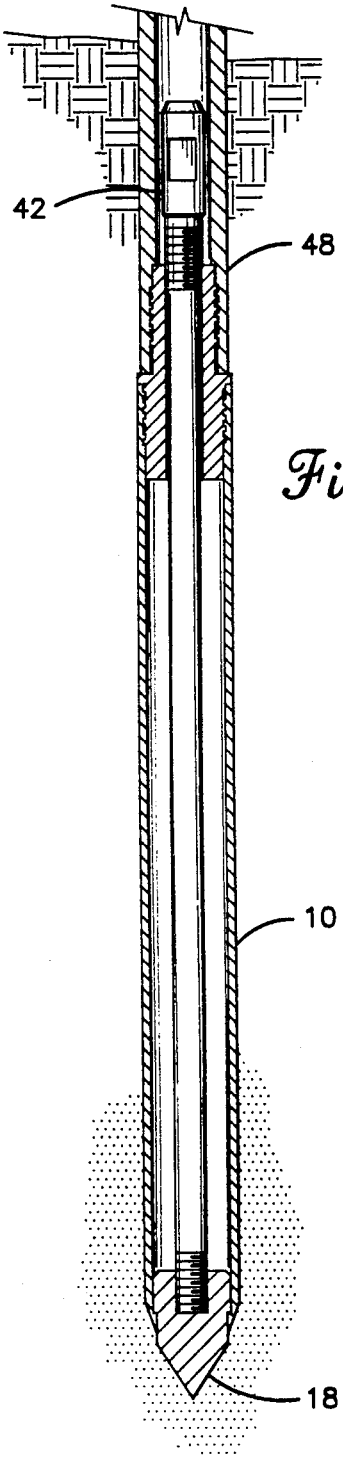
Figure 3B:
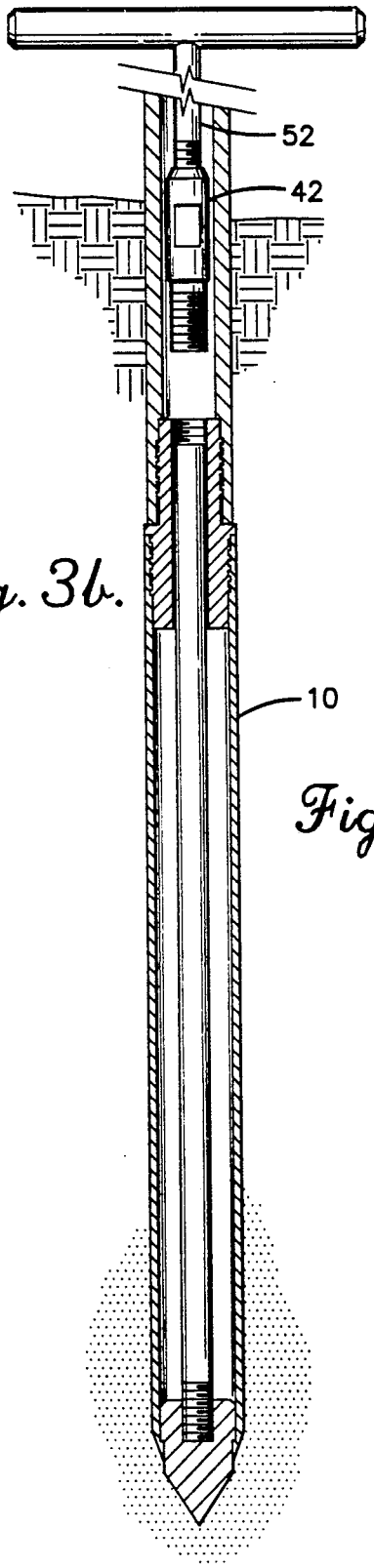
Figure 3C:
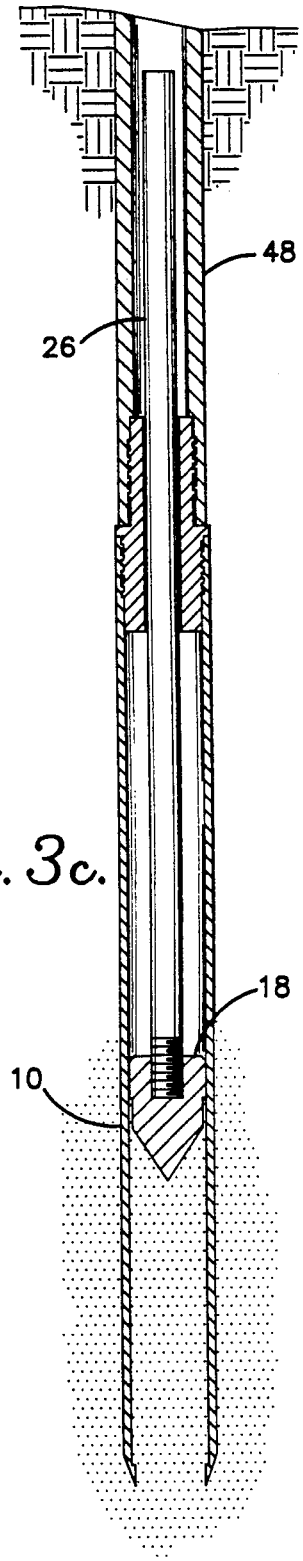

FIG. 2 shows the elements described above, and shows further elements of the present invention. First, connected to the drive head 32 are a series of probe extensions 48. Each of the probe extensions is substantially identical, and is formed generally as an open ended hollow cylinder with a diameter substantially equal to, or slightly less than, the diameter of the sample case 10. The interior of the forward end of each probe extension includes female threads capable of mating with standard threads 38 on the exterior of the rearward end of the drive head. At the rearward end of each probe extension 48, exterior threads 50 are formed. Threads 50 are standard threads which correspond to threads 38 on the drive head. With this arrangement, a plurality of probe extensions may be releasably connected in series, with the forwardmost probe extension threaded to drive head 32 and each successively rearward probe extension threaded to the probe extension immediately forward thereto.

The means for releasing the piston tip and piston rod from the fixed position is also shown in FIG. 2. A series of extension rods 52 may be inserted through the hollow probe extensions 50. Each of the extension rods is formed as an elongated cylinder having standard exterior threads 54 at each end thereof. A plurality of extension rod couplers 56 are used to maintain the rods in end-to-end relationship. The rod couplers may be formed as short hollow cylinders having standard interior threads (not shown) corresponding to threads 54 on the extension rods. The extension rods are connected in series by threadingly engaging associated ends of successive extension rods with a portion of the length of one of the rod couplers. The exterior of the rod couplers may be knurled or roughened to facilitate hand tightening, or may adapted for engagement with a tool for tightening the rod coupling to the extension rods.

At the rearward end of the series of extension rods, a handle 58 is threaded to the rearwardmost set of the threads 54. The handle 58 is used for manual rotation of the extension rods for the purpose explained below.

The forward end of the series of extension rods presents a set of the threads 54 which is not engaged with a rod coupler. This forwardmost set of threads 54 is adapted to engage the threads 46 in the interior of the rearward end of piston stop 42. The threads 46 and 54 are standard threads, and as such are engaged by right-handed turning of extension rods 52 (clockwise when viewed in the direction of driving).

However, as noted above, the threads connecting piston stop 42 to drive head 32 are reverse, or left-handed. As such, when the threads of the extension rod and piston stop have been fully engaged by right-handed turning, continued right-handed turning of the extension rods will cause right-handed turning of the piston stop. This will eventually disengage the threaded connection between the piston stop and the drive head, thereby releasing the piston tip and piston rod from their fixed position within the sample tube.

It should be noted that the arrangement of the threads ensures proper disengagement of only the piston stop. The right-handed turning to disengage the piston stop does not loosen the other threaded connections, but in fact tightens them. There is thus little opportunity for the connections between extension rods, or the connection between the extension rods and the piston stop, to fail during removal of the piston stop.

While the invention has been described as using a piston stop with a threaded connection, various other arrangements are contemplated. For example, the piston stop could be fixed to the drive head by means of a sliding lock-sleeve coupling common to pneumatic devices. Movement of the lock-sleeve could be effected by a semi-flaccid member fixed to the sleeve and threaded through the probe extensions as the are added, or by a member inserted into the assembled probe extensions and adapted to engage and allow pulling of the sleeve.

Alternatively, the piston stop could be formed as a pin member extending laterally through a portion of the drive head and into the through-hole 40. The pin member would be movable from this extended position to a retracted position in which it does not block the through-hole. The pin member may have an inclined surface to engage the piston rod 26 to ensure that the piston tip is firmly sealed to the front of the sample tube. Movement of the pin member between these positions may be effected by several different means.

A pneumatic or hydraulic piston could be connected to the pin member. Compressed air or hydraulic could be supplied to move the piston by lines threaded through the probe extensions as they are added, or by lines inserted into the assembled probe extensions. The pneumatic or hydraulic pressure could also be applied to the piston prior to insertion into the soil and the released at the proper depth to allow movement of the pin member by springs or other means. An electric solenoid could also be used to move the pin member, with control of the solenoid by conductors connected as with the lines above, or by remote radio control.

The operation of the invention shown in FIGS. 1 and 2 will now be described with reference to FIGS. *3a–3c*.

FIG. *3a* shows the sample tube, with piston tip in place, being inserted into the ground. This is effected by connecting the sample case, with few, if any, probe extensions attached, to a suitable driver (not shown). Any commonly known driver which may be operatively connected to the present device, manual or powered, may be used. The driver may be percussive with several hundred to a few thousand impacts per minute, or may exert a steady force. The driver may advantageously be connected to the present device through the use of the threads 38 on the drive head, or the rearwardmost free set of the threads 50 on the probe extensions 48.

The sample tube is driven to the desired depth by the driver. Probe extensions 48 may be successively added to the rear of the device to maintain a sufficient portion of the device extending out of the soil for proper connection with the driver. Driving of the device is stopped when the forward end of the sample tube has reach the position at which the soil sample is desired to begin.

Throughout the driving of the device, the piston tip has remained in the forward fixed position in the sample tube. As such, little or no soil or contaminates have entered the sample tube. The piston tip must be released from the fixed position, however, to allow the soil sample to enter the sample tube.

FIG. *3b* shows the release of the piston tip. Successive extension rods are connected by the rod couplings to lower the extension rods through the series of probe extensions. Insertion of the extension rods may require partial or full removal of the driver, depending upon the type used. When a sufficient length of extension rods has been inserted, the forward end of the rods will be in proximity to the piston stop. The handle may be connected to the rear of the extension rods at this point. The threaded forward end of the extension rods is engaged with the threads 46 in the piston stop by right-handed turning. Upon full engagement of the threads, the turning is not stopped, but continues until the piston stop has been disengaged from the drive head. At this point the piston tip and piston rod have been released, and the extension rods and attached piston stop may be removed from the interior of the probe extensions.

With the piston tip and piston rod released, a soil sample may be taken. This is shown in FIG. *3c*. The driver is again connected to the device as before, if necessary. The device is then driven an additional amount corresponding to the desired length of the soil sample. During this driving, the sample tube is moved forward. However, since the piston stop has been removed, the force of the soil against the piston tip maintains the piston tip substantially fixed with respect to the soil. The sample tube therefore slides over the piston tip, and the soil sample enters the sample tube.

The sliding engagement of the cylindrical tip body 24 with the interior of the sample tube and the sliding engagement of the piston rod 26 within the through-hole 40 ensures that the piston tip slides easily with respect to the sliding tube. This is an important factor, since at most a partial sample would be taken if the piston tip jammed within the sample tube. In this regard, it is noted that the forward portion of driving head 32 will act as a stop and limit movement of the piston tip. It is therefore important that the length of the sample tube which is actually available to contain a soil sample be sufficiently long for the purpose intended. Sample tubes of various lengths could, of course, be provided.

When the device has been driven a sufficient depth to obtain the soil sample, the device is withdrawn from the soil by reversing the steps used to introduce the device into the soil. Specifically, the device is driven rearwardly, possibly using the same driver used to drive the device forward. When sufficient lengths of the device extend from the soil, an appropriate number of the rearwardmost probe extensions are removed. The driver is then reattached to the device and the process is repeated until the device is fully withdrawn from the soil.

At this point the driving head may be removed from the sample tube. This also allows the piston tip to be removed, since the piston tip is located rearwardly of the soil sample. The soil sample can then be extruded from the sample tube using a driven plunger moving through the sample tube. If the sample is to be tested in a laboratory, appropriately sized end caps may be placed on the ends of the sample tube to avoid contamination of the sample. This is particularly advantageous, since it allows safe, convenient transport of the sample to an appropriate laboratory for analysis.

As many modifications of the disclosed soil probe are possible, it is to be understood that the disclosed embodiments are merely examples thereof, and that the invention includes all modifications, embodiments and equivalents thereof falling within the scope of the appended claims.

What is claimed is:

1. A soil sample probe for taking subterranean soil samples, said probe comprising:

a sample container elongated along a longitudinal axis, said container being hollow and having an open forward end and an open rearward end;

a piston tip slidably received within said sample container; and means connected to said sample container proximate said open rearward end for releasably fixing said piston tip in a driving position in which said tip is received in and closes the open forward end, the releasably fixing means including a drive head connected to said sample container at said rearward end, said drive head including a through-hole extending longitudinally therethrough parallel to said longitudinal axis, a piston rod fixed to said piston tip and extending rearwardly therefrom to a free end, at least a portion of said piston rod being received within said through-hole, and a piston stop directly and releasably connected to the drive head in disposition for blocking said through hole rearwardly of said free end of the piston rod and abutting the free end of said piston rod to releasably fix the piston tip in said forward position.

2. A sample probe as in claim 1, wherein said open forward end of said sample container includes a portion of reduced cross-sectional area which thereby defines an interior shoulder, and said piston tip includes a tip portion and a tip body rearwardly of said tip portion, said tip body having a cross-sectional area greater than that of said tip portion and thereby defining an exterior shoulder, said shoulders being adapted to mate when said piston tip is in said forward position.

3. A soil sample probe as in claim 2, wherein said portion of said forward end and said tip portion have substantially equal cross-sectional areas and substantially mate, and the cross-sectional area of the interior of said sample container is substantially constant and is substantially equal to and substantially mates with the cross-sectional area of said tip body.

4. A soil sample probe as in claim 1, wherein at least a portion of said through-hole is threaded, said portion of said through-hole beginning at a rearwardmost end of said through-hole, and wherein said piston stop is releasably threaded to said through-hole.

5. A soil sample probe as in claim 4, wherein said through-hole is threaded with left-handed threads.

6. A soil sample probe as in claim 5, wherein said drive head is releasably connected to said sample container by right-handed threads.

7. A soil sample probe as in claim 1, in combination with:

a plurality of probe extensions, each of said extensions being elongated along a longitudinal axis, being hollow and having first and second open ends, each of said extensions being releasably connected together with said longitudinal axes coaxial and adjacent ones of said extensions having a respective said first end and a respective said second end in contact, thereby forming a series of said extensions with a rearwardmost one of said extensions having an associated said second end free, and a forward most one of said extensions having an associated said first end releasably connected to said drive head of said sample probe.

8. A combination as in claim 7, further in combination with:

a plurality extension rods, each of said rods being elongated along a longitudinal axis and having longitudinal ends, respective ones of said ends of adjacent ones of said extension rods being releasably connected together with said longitudinal axes coaxial thereby forming a series of said extension rods, said series of extension rods extending into said series of probe extensions; and means located on a forwardmost one of said ends of a forwardmost one of said extension rods for releasably engaging said piston stop for removing said piston stop from said through-hole, said means releasably engaging said piston stop, whereby said piston stop can be removed from said through-hole to thereby release said piston tip from said driving position.

9. A combination as in claim 8, wherein said drive head includes exterior threads, said first ends of said probe extensions include interior threads engageable with said exterior threads on said drive head, and said second ends of said probe extensions include exterior threads engageable with said threads on said first ends of said probe extensions, and wherein said series of said probe extensions is releasably connected together and to said drive head by said threads.

10. A combination as in claim 9, Wherein at least a portion of said through-hole is threaded, said portion of said through-hole beginning at a rearwardmost end of said through-hole, and wherein said piston stop is releasably threaded to said through-hole.

11. A combination as in claim 10, Wherein a rearward end of said piston stop includes a threaded hole extending therein, and said means located on said forward most end of said forwardmost extension rod for releasably engaging said piston stop is threads engageable with said threaded hole in said piston stop.

12. A combination as in claim 11, wherein said through-hole in said drive head is threaded with left-handed threads and the remainder of said threads are right-handed.

13. A combination as in claim 12, further including, releasably connected to a rearwardmost end of said series of extension rods, means allowing manual rotation of said series of extension rods.

14. A soil sample probe for taking subterranean soil samples, said probe comprising:

a hollow elongated sample container having an open forward end and rear wall means having an opening extending therethrough;

a piston tip slidably received in said sample container for movement between a driving position in which said piston tip closes said open forward end to prevent ingress of soil into said soil container during driving of said soil container, and a second position in which said piston tip is spaced rearwardly of said driving position;

elongated rigid rod means operably connected to said piston tip for movement therewith and projecting rearwardly therefrom, said rod means being slidably received in said opening of said wall means; and removable stop means carried by said container and engageable with said rod means for mechanically blocking the rod means for releasably attaching the rod means to the container for fixing the position of said rod means, and therefore said piston tip, with respect to said opening in said driving position for forward movement solely by driving forces applied to the container.

15. A soil probe as in claim 14, wherein said means for fixing comprises a piston stop.

16. A method of taking a subterranean soil sample, comprising the steps of:

providing a soil sample probe, the probe comprising a hollow elongated sample container having an open forward end and rear wall means having an opening extending therethrough; a piston tip slidably received in the sample container for movement between a driving position in which the piston tip closes the open forward end to prevent ingress of soil into the soil container during driving of the soil container, and a second position in which the piston tip is spaced rearwardly of the driving position; elongated rigid rod means operably connected to the piston tip for movement therewith and projecting rearwardly therefrom, the rod means being slidably received in the opening of the wall means; means carried by the container and engageable with the rod means for releasably and mechanically fixing the position of the rod means, and therefore the piston tip, with respect to the opening to releasably fix the piston tip in the driving position for forward movement solely by driving forces exerted on the container;

driving the sample container forward to a desired position within the soil;

releasing the means for releasably fixing the rod means, thereby releasing the rod means and the piston tip;

driving the sample probe forward a distance less than the length of the sample container; and removing the sample container from the soil.

17. A soil sample probe for driving into the ground to take soil sample from a subterranean soil region, said probe comprising:

an elongated, hollow tubular container having an open forward end and an open rearward end;

a piston tip slidably received in the container, said tip having a driving position closing the forward end of the container and being slidable toward the rearward end of the container when it si desired to admit the sample into the container; and a slidable mechanical connection between the tip and the container for holding the tip in said driving position for forward movement solely by driving forces exerted on the container until the probe reaches said region, said connection being selectively releasable when the probe reaches said region to permit the driving of the container without holding the tip to cause the latter to slide toward said rearward end to admit said sample.

* * * * *

UNITED STATES PATENT AND TRADEMARK OFFICE

CERTIFICATE OF CORRECTION

PATENT NO. : 5,186,263

DATED : February 16, 1993

INVENTOR(S) : Melvin P. Kejr and Thomas M. Christy

It is certified that error appears in the above-identified patent and that said Letters Patent is hereby corrected as shown below:

On the title page after "Inventors:", "Saline" should be --Salina--.
Column 2, line 59 of the patent, "18" should be --10--.
Column 3, line 40 of the patent, "3" should be --30--.
Column 4, line 40 of the patent, after "may" insert --be--.
Column 5, line 11 of the patent, delete "as the" and insert --as they--.
Column 5, line 25 of the patent, after "hydraulic" insert --fluid--.
Column 5, line 30 of the patent, delete the second occurrence of the word "the".
Column 7, line 8 of the patent, after "said" insert --piston--.
Column 8, line 23 of the patent, the word "Wherein" should be changed to lower case --wherein--.
Column 8, line 28 of the patent, the word "Wherein" should be changed to lower case --wherein--.
Column 10, line 15 of the patent, delete "si" and insert --is--.

Signed and Sealed this

Eighteenth Day of January, 1994

*Attest:*

Bruce Lehman

BRUCE LEHMAN

*Attesting Officer*

*Commissioner of Patents and Trademarks*